United States Patent [19]

Walla

[11] Patent Number: 4,609,233

[45] Date of Patent: Sep. 2, 1986

[54] FURNITURE LOCKING SYSTEM

[75] Inventor: Gregg W. Walla, Lake Bluff, Ill.

[73] Assignee: Timberline Supply, Ltd., Lake Bluff, Ill.

[21] Appl. No.: 549,273

[22] Filed: Nov. 3, 1983

[51] Int. Cl.[4] ..... E05B 65/46

[52] U.S. Cl. ..... 312/219; 70/82; 70/86; 70/120; 292/39; 292/141; 292/142; 312/107.5; 312/215; 312/216; 312/222

[58] Field of Search ..... 312/107.5, 215, 216, 312/217, 218, 219, 220, 221, 222, 333; 292/139, 140, 141, 142, 34, 36, 39, 38, 28, 50; 70/86, 120, 82, 78, 256

[56] References Cited

U.S. PATENT DOCUMENTS

| | | | |
|---|---|---|---|
| 963,669 | 7/1910 | Walker et al. | 312/107.5 |
| 1,014,145 | 1/1912 | Graham . | |
| 1,426,308 | 8/1922 | Maloney . | |
| 1,724,424 | 8/1929 | Sandholdt, Jr. . | |
| 2,116,707 | 5/1938 | Morrell | 403/383 X |
| 2,142,092 | 1/1939 | Clark | 403/383 X |
| 2,149,754 | 3/1939 | Whiteford . | |
| 2,202,422 | 5/1940 | Hoof . | |
| 2,218,257 | 10/1940 | Bulat . | |
| 2,225,243 | 12/1940 | Zottel | 312/219 |
| 2,634,991 | 4/1953 | Stevens | 403/383 |
| 2,793,927 | 5/1957 | Reitzel . | |
| 3,360,318 | 12/1967 | Studinski | 312/217 |
| 3,404,929 | 10/1968 | Wright . | |
| 3,589,152 | 6/1971 | Glass et al. | 70/86 X |
| 3,762,750 | 10/1973 | Orr | 292/140 |
| 3,767,280 | 10/1973 | McLaughlin | 312/219 |
| 3,776,007 | 12/1973 | Himsl | 312/219 X |
| 4,303,287 | 12/1981 | Taplin | 312/107.5 X |

FOREIGN PATENT DOCUMENTS

| | | | |
|---|---|---|---|
| 1084096 | 8/1980 | Canada | 312/217 |
| 1804886 | 6/1970 | Fed. Rep. of Germany | 292/39 |
| 46223 | 4/1936 | France | 70/120 |
| 473299 | 6/1969 | Switzerland | 312/219 |

*Primary Examiner*—William E. Lyddane
*Assistant Examiner*—Thomas A. Rendos
*Attorney, Agent, or Firm*—Wood, Dalton, Phillips Mason, and Rowe

[57] ABSTRACT

An improved locking system for furniture of the type having a plurality of drawers, at least one of which is locked from a remote position through a keyed operator module by translating a slide bar to interfere with one of the drawers in a locked position. A flexible, rotatable cable extends between the operator module and a connector/actuator module associated with the slide bar. The connector/actuator module comprises a crank with an integral shaft and rotatable, eccentric lug which is directed in an L-shaped slot in a slide plate. Rotation of the cable imparts translatory movement to the slide plate which is followed by the slide bar. In another aspect of the invention, the operator module, which is geared to the cable through a translatable rack, causes extension of a bolt on the rack to lock a second drawer simultaneously as the slide bar realizes a locked position. The modular construction of the connector/actuator and operator permits separate manufacture and assembly after which the cable can be operatively engaged with each.

27 Claims, 10 Drawing Figures

10
19
12
46
54
52
58
50
17
14
48
96
16
22
28
26

50
98
122
134
118
124
126
138
136
142
132
127
120
125
130
150
158
170
166
128
148
164
146
152
26
140
44

108
97
106
116
100
68
112
70
65
54
56
84
66
88
72
60
104
102
52
95
86
62
64
92
94
82
90
78
80
76
114
110
46

FIG. 4
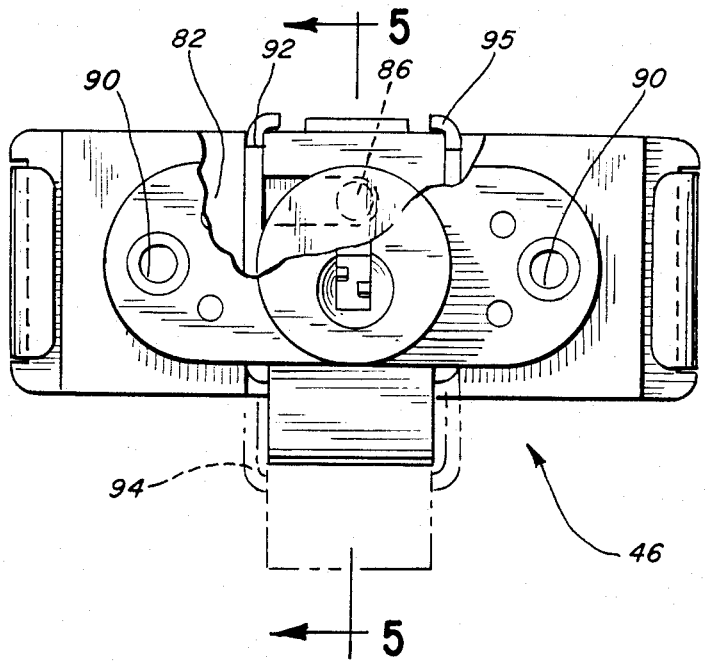
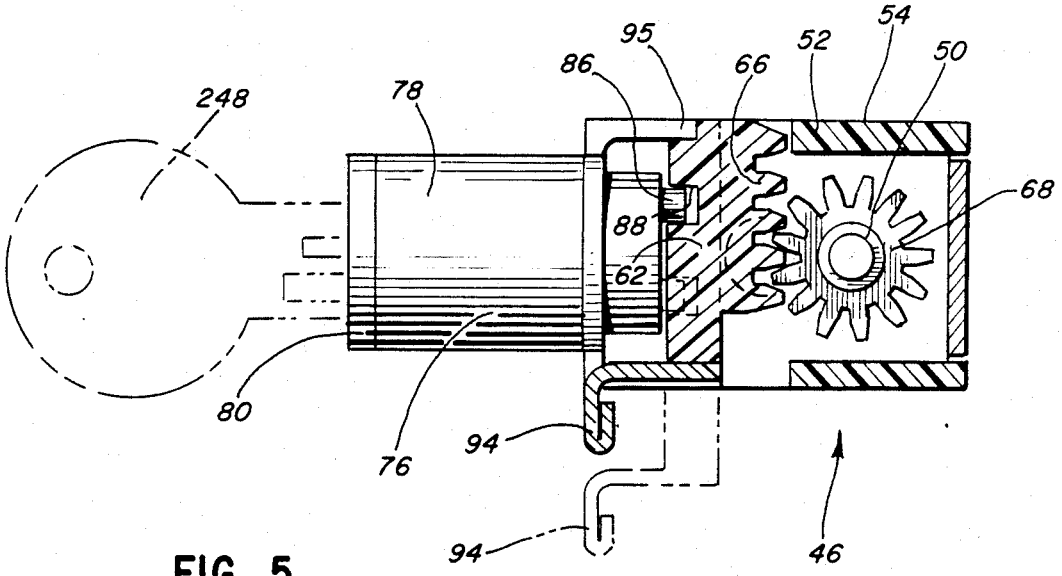
FIG. 5

FIG. 7
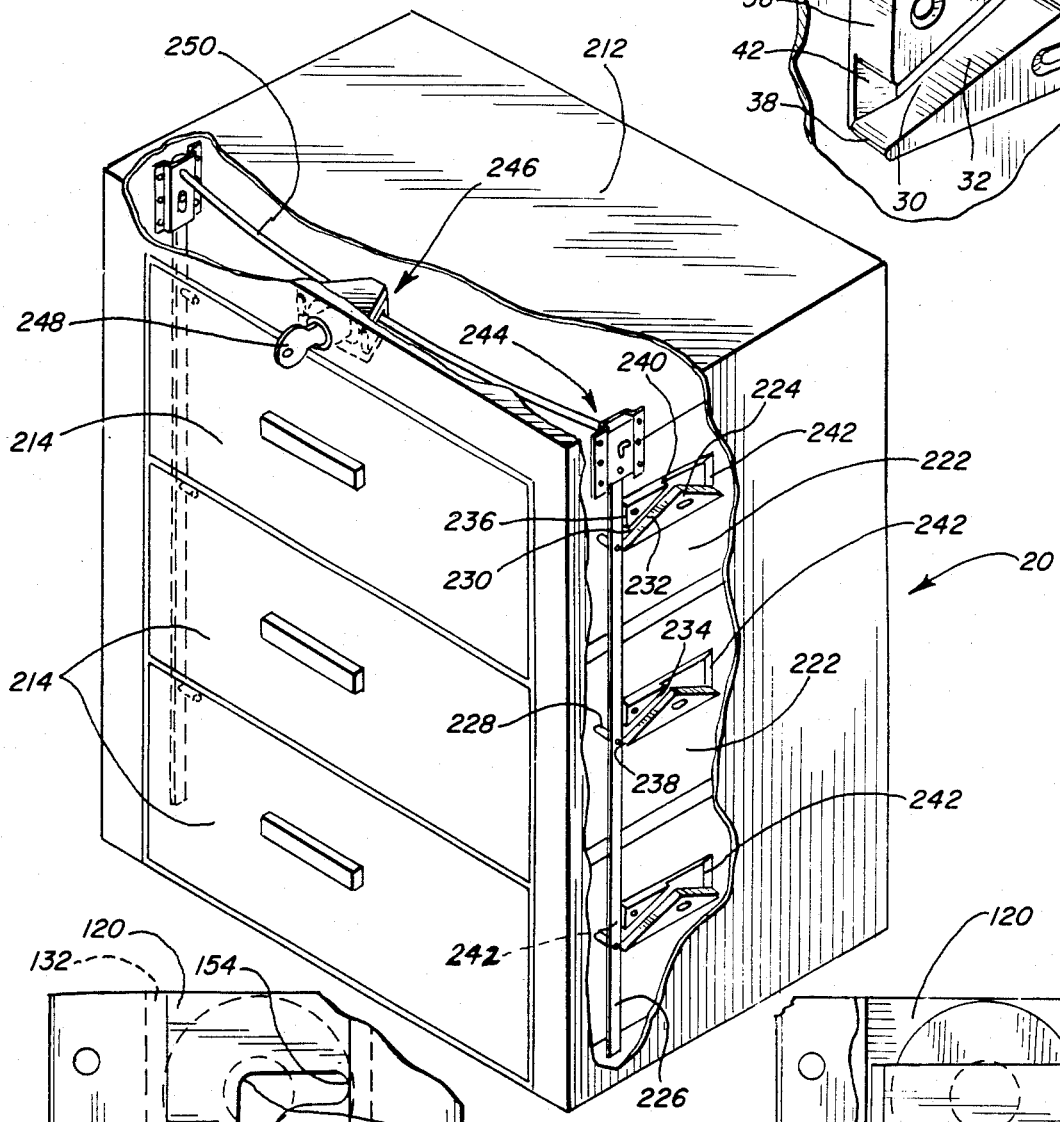
FIG. 8
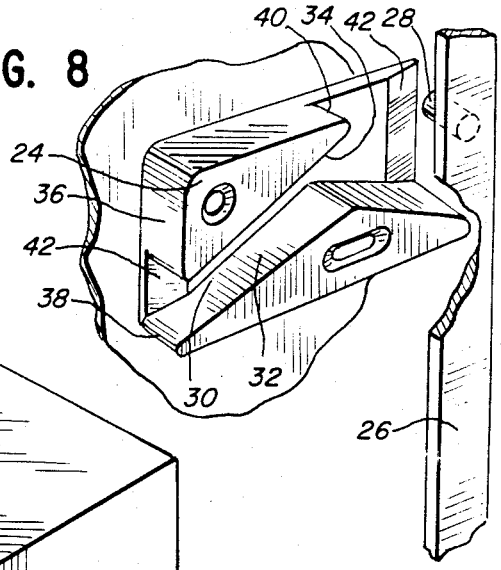
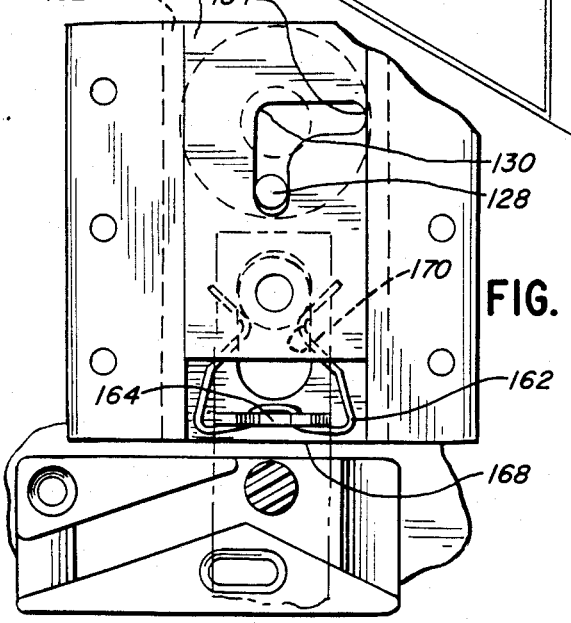
FIG. 9
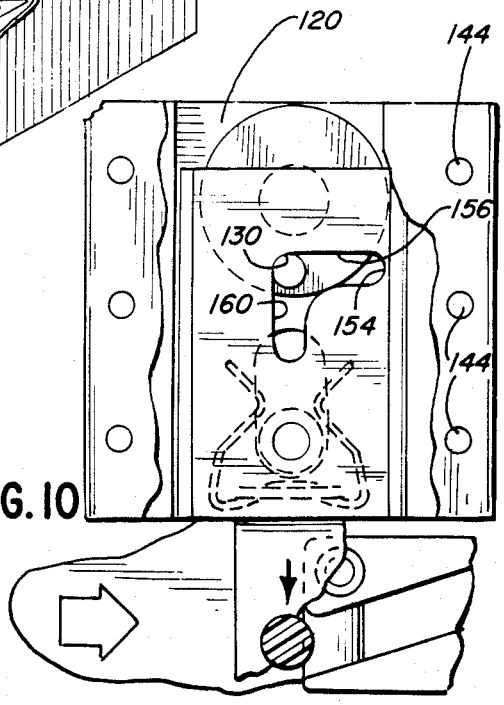
FIG. 10

FURNITURE LOCKING SYSTEM

This invention relates to locking systems for furniture and more particularly to a remotely controlled drawer lock.

BACKGROUND OF THE INVENTION

Furniture locks, and particularly those suitable for simultaneously locking a plurality of stacked drawers, generally incorporate a reciprocative, vertically tracked locking bar. A plurality of lugs on each bar interferingly engage a blocking surface associated with each drawer in a locked position.

Typically, a keyed operator, through an intermediate linkage, effects translation of the slide bar which assumes, depending on the position of the key, either a locked or unlocked position. Exemplary of such a structure is that shown in U.S. Pat. No. 3,776,007, to Himsl. In Himsl, rotation about a first axis of a keyed operator directs an eccentric lug slidably within an elongate slot of a transverse rigid bar so that the bar is rotated. Vertical reciprocative motion of the slide bar is imparted from the rigid bar through an intermediate rocker arm. By turning the key, the lugs associated with the slide bar selectively either raise to seat in a locking bracket or lower to free the drawers for withdrawal.

The primary drawback with the Himsl mechanism is that very close tolerances are required in assembling the mechanism to assure proper alignment of coacting elements. Assembly of the locking system is complicated and the attendant costs thereby increased.

Further, given the typical, rigid, unitary nature of the prior art structures, each particular design is suitable for but a single desk or drawer configuration. Consequently closely dimensioned parts must be manufactured and inventoried to handle a wide range of desk constructions. Also, during use, the locking elements in the prior art, including those in the Himsl patent, might become misaligned thereby causing the locking system to malfunction.

SUMMARY OF THE INVENTION

The present invention overcomes the problems of the prior art in a novel and simple manner. In one aspect of the invention, a connector/actuator unit is provided which can be installed at a location remote from an operator. The connector/actuator and operator are interconnected by a flexible, rotatable cable operable preferably by means of a key.

The connector/actuator and operator are each self-contained modules and can be installed in different relative orientations and spaced at different intervals limited only by the length of the cable. Installation involves a simple separate mounting of the modules. With the connector/actuator and operator appropriately in place, the cable can be located against the operator and fixed by a clip and the free end of the cable press fit to the connector/actuator. The cable is deformable to adjust the spacing between the free end and the point of connection with the operator. Thus one cable length can be used to link connector/actuators and operators through a range of spacing. Great system flexibility and versatility is thus afforded.

It is also an object of the invention to provide a connector/actuator that is reliable, smoothly operable and which positively repositions the slide bar in response to movement of the keyed operator. A connector crank is provided and has a rotary shaft with a coaxial slot keyed to the end of the cable. The shaft is integral with a disk carrying an eccentric pin which rotates about the shaft axis in response to rotation of the flexible cable.

The pin moves in an L-shaped slot in a slide plate which is attached to a slide bar carrying one or more locking lugs. The slide plate is selectively biased by a hair spring to either of two thrown positions. The plate may move reciprocatively when positioned in the vertical leg of the L slot, which represents the unlocked state. The plate is prohibited from moving with the pin disposed in the transverse portion of the slot and the drawers are thereby locked. In the former position, a ramp surface on the drawers encounters and freely deflects the lugs and associated slide bar as the drawers are either opened or closed.

The invention has as another of its objects the provision of a keyed operator that simultaneously operates the connector/actuator and shifts a locking bolt. This arrangement is suitable for simultaneously locking a centrally located drawer and spaced drawer columns having associated reciprocative slide bars.

The keyed operator has a rotatable barrel and is mounted in a housing having a guide slot for a toothed rack. The barrel has an eccentric pin engaging a slot in the rack so that rotation of the barrel through the key effects translational movement of the rack in the guide slot. The toothed rack drivingly engages a gear associated with the cable. Upon translating the rack in a first direction, a tab associated with the bolt engages the central drawer to prohibit withdrawal and simultaneously rotates the cable causing the remote connector/actuator to fix the slide bar in a locked position.

BRIEF DESCRIPTION OF THE DRAWINGS

FIG. 4 is a rear elevation view of the operator module of FIG. 2;

FIG. 5 a sectional view of the operator module along line 5—5 of FIG. 4;

FIG. 7 is a perspective view of a modified form of locking system according to the present invention;

FIG. 8 is a fragmentary perspective view of the coacting structure on the slide bar and drawers.

FIG. 9 is a side elevation view of the connector/actuator module with the slide bar in a locked position; and FIG. 10 is a side elevation view of the connector/actuator module with the slide bar in an unlocked position.

DETAILED DESCRIPTION OF THE DRAWINGS

Figures 1, 2, 3:
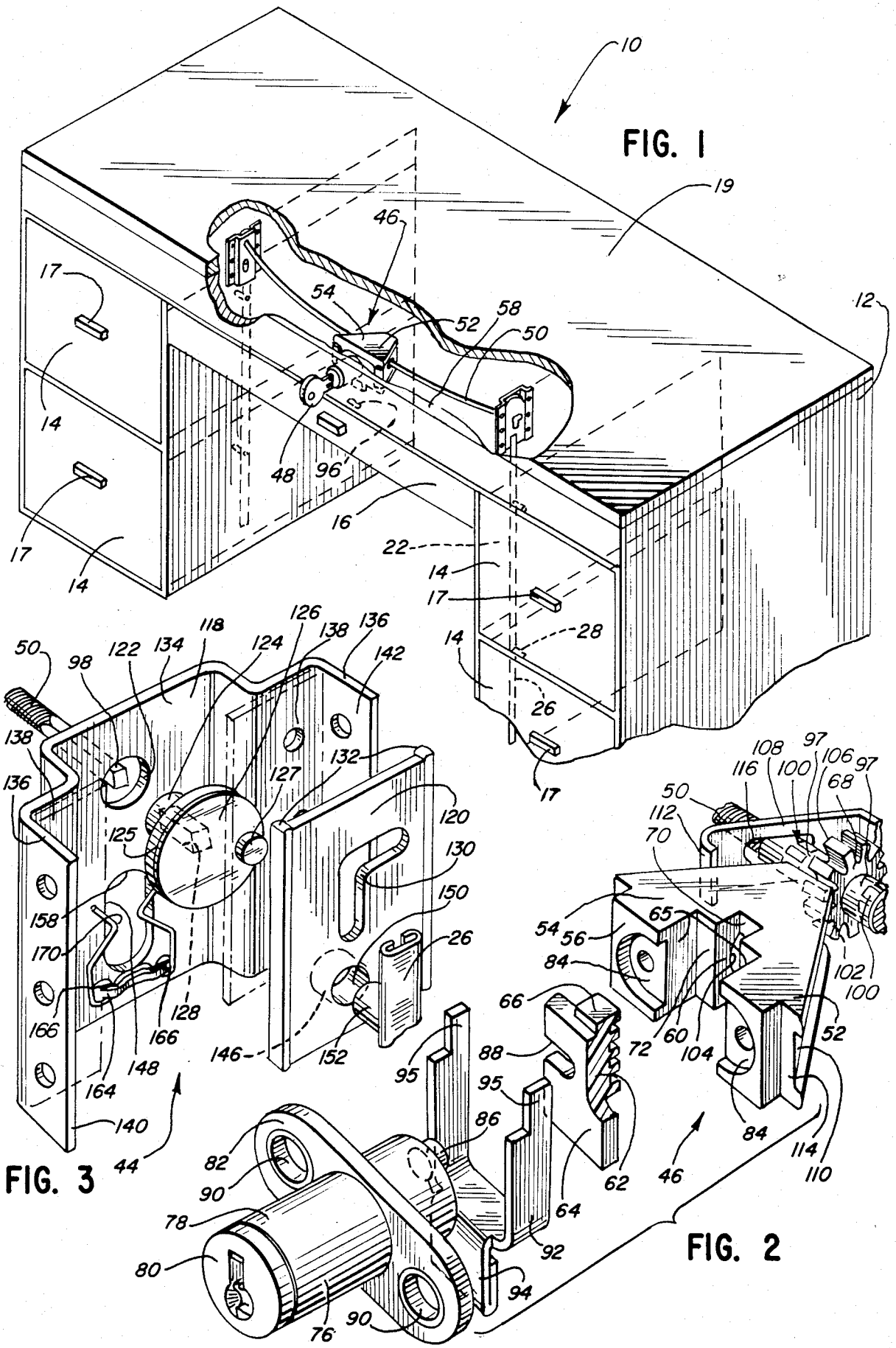
FIG. 1 is a perspective view of a conventional desk broken away to reveal a locking system according to the present invention.
FIG. 2 is an exploded perspective view of a keyed operator module for operating a connector/actuator module for a slide bar associated with the system of FIG. 1.
FIG. 3 is an exploded perspective view of a preferred form of the connector/actuator module.
Figure 6:
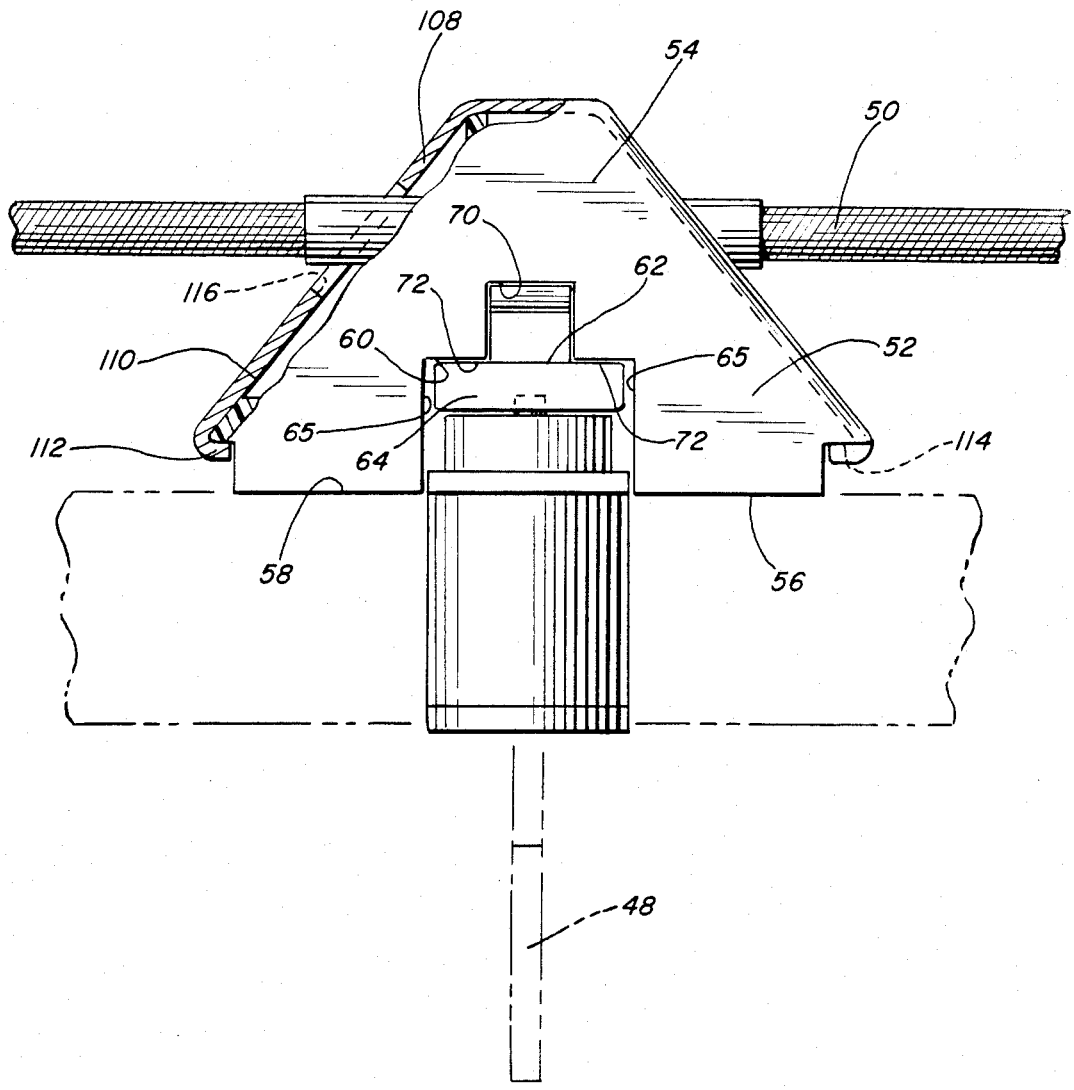
FIG. 6 is a plan view of the operator module partially broken away to reveal a retaining clip for a cable extending between the operator module and the connector/actuator module.

A preferred form of the invention is shown in FIG. 1 operatively associated with a conventional-type desk, generally designated 10. The desk 10 comprises a cabinet or support 12 accommodating laterally spaced columns of drawers 14 and a central drawer 16, all of which can be slidably withdrawn from the front of the desk 10 by drawing upon handles 17. The slidable drawer mounting structure is conventional and does not form part of the present invention. An unobstructed region 18 is defined beneath the central drawer 16 and permits positioning of a user appropriately for use of the desk top surface 19.

The drawer locking structure between the cabinet 12 and drawers 14 is likewise conventional and is detailed in FIGS. 7 and 8 as well as FIG. 1. The invention is incorporated into a single column of drawers 20 in FIG. 7 and is in all other respects consistent with the arrangement in FIG. 1. Like parts in FIGS. 1 and 7 are designated with corresponding numbers with the elements in FIG. 7 numbered in the 200's.

Each drawer 14, 214, is substantially rectangular and carries on its sidewall 22, 222 a ramp plate 24, 224 which cooperates with a vertically disposed, sliding locking bar 26, 226 formed of strap metal. The bars 26, 226 are carried by the cabinet 12, 212 and situated adjacent the sidewalls 22, 222 carrying the ramp plates 24, 224. Each locking bar 26, 226 has integral cylindrical lugs 28, 228 projecting laterally towards each of the ramp plates 24, 224.

With the drawers 14, 214 in a closed position, the lugs 28, 228 each align adjacent the front edge of one of the plates 24, 224 as illustrated in FIG. 7. Each plate 24, 224 has a substantially rectangular configuration and defines an inclined guide slot 30, 230 having a width sufficient to accept the lugs 28, 228. Each slot 30, 230 is defined by first and second opposed ramp surfaces 32, 232 and 34, 234 respectively. It can be seen that as one of the drawers 14, 214 is withdrawn, the lug 28, 228 associated with that drawer will be urged upwardly by the first ramp surface 32, effecting vertical upward shifting of the locking bar 26, 226. This action misaligns the lugs 28, 228 and slots 30, 230 on the remainder of the drawers 14, 214 and situates the lugs 28, 228 in front of a vertical blocking surface 36, 236 on the forward portion of the ramp plates 24, 224. The blocking surface 36, 236 on each ramp plate 24, 224 engages the respective lug 28, 228 to prohibit withdrawal of each of the other drawers 14, 214. This arrangement forbids removal of more than one drawer at a time to prevent inadvertent tipping of the cabinet. Upon closing the one drawer, the lug adjacent the plate 24, 224 on the one drawer 28, 228 encounters the second ramp surface 34, 234 and translates the locking bar 26, 226 vertically downward into a position so that any of the drawers 14, 214 can be opened.

To assist guiding of the lugs 28, 228 along the ramp plates 24, 224 the leading edge 38, 238 of the first ramp surface 32, 232 is rounded. The rounded edge 38, 238 deflects the lug 28,228 properly onto the first ramp surface 32. The leading edge 40, 240 at the second ramp surface 34, 234 is similarly contoured to assist entry of the lug 28, 228 as the drawer 14, 214 is closed. Further, a beveled surface 42, 242 is provided at the ends of the ramp plate 24, 224 to prevent the free ends of the lugs 28, 228 from binding as the lugs 28 pass over either end of the ramp plate 24, 224.

As will be obvious to those skilled in the art, the lugs 28,128,228 define translatable locking bolts which may be disposed selectively on one of the support 26,126,226 and the drawer intended to be locked with the cooperating ramp plate mounted on the other of the drawer or support.

The instant invention is concerned with the control of the locking bar 26, 226 and comprises a connector-/actuator module at 44, 244 associated with each bar 26, 226 as detailed in FIGS. 3, 9 and 10 and a remote keyed operator module at 46, 246 for operating the connector-/actuator module 44, 244. The details of the operator module 46, 246 are illustrated in FIGS. 1, 2 and 4–7. Manipulation of the key 48, 248 rotates a flexible cable 50, 250 which in turn operates the connector/actuator module 44, 244 to selectively raise or lower the locking bar 26, 226. By manually moving the bar 26, 226 the drawers 14, 214 can be simultaneously either locked or released.

Referring initially to the operator module 46 of FIGS. 1, 2 and 4–6, a housing 52 is provided and preferably has a flat upper surface 54 which seats flushly beneath the desk top 19, and a flat forward face 56 making a right angle with the upper surface 54 and residing closely against the forward wall 58 of the cabinet 12.

The housing 52 has a T-shaped cutout 60 of sufficient depth to accommodate a rack 62. The rack 62 has a rectangular body 64 fitting closely between the sidewalls 65 of the cutout 60 and an integral, vertical column of square teeth 66 which mesh with a gear 68 on the cable 50. The teeth 66 fit closely in the base 70 of the cutout 60 with the body 64 abutting a shoulder 72 simultaneously as the teeth 66 encounter the base 70 of the cutout 60. This arrangement positively tracks the rack in a vertical line.

To effect translation of the rack 62, a keyed tumbler 76 is provided. The tumbler 76 has a cylindrical housing 78 which retains a conventional rotatable, keyed barrel 80. A flat plate 82 is fixedly attached with the housing 78, received in a correspondingly configured recess 84 in the housing 52 and used to secure the tumbler 76 with the housing 52.

To operate the rack 62, the barrel 80 is provided with an eccentric lug 86 which is received in a U-shaped slot 88 in the body 64 of the rack 62. As the barrel 80 is rotated the movement of the lug 86 in the slot 88 effects reciprocative movement of the rack 62 which is transmitted as rotary motion to the cable 50 about its longitudinal axis.

To maintain the operator module 46 in operative relationship with the housing 52, aligned holes 90 are provided in the plate 82 and housing 52 between which the rack 62 is captured. Bolts, or other suitable fasteners can be utilized to join the housing 52 and tumbler 76 and the housing 52 and cabinet 12.

It is another aspect of the invention to lock the center drawer 16 simultaneously with the spaced side drawers 14. To accomplish this end a U-shaped bolt 92 having an integral depending tab 94 surroundingly engages and follows the movement of the rack 62. In the illustrated structure, the legs 95 of the bolt 92 are bent over the upper portion of the rack 62. As the rack translates downwardly to lock the drawers 14, as shown in FIGS. 4 and 5, the tab 94 seats in a slot 96 in the center drawer 16 to prohibit removal of the center drawer 16. It should be understood that the bolt could operate as well to lock a pivoting or slidable door.

The gear 68 has integral, oppositely extending sleeves 97 which fit closely over the cable. The cable, with the exception of its free ends 98 (FIG. 3), is circular in cross-section along its length. The gear 68 is slidable selectively along the length of the cable. With the gear 68 in a desired location, the sleeves 97 can be crimped at 100 in conventional manner. Preferably the gear 68 and sleeves 97 are made from brass or other soft metal to facilitate crimping.

To assemble the gear 68 with the operator, a cavity 102 is provided at the rear of the housing to receive the gear 68 and sleeves 97. An opening 104 admits the teeth 106 of the gear 68 into the cutout 60 to mesh with the teeth 66 on the rack 62. With the gear 68 in place on the operator 46, a retaining clip 108 is assembled about the housing 52 and captures the gear 68. The clip 108 fits in a peripheral guide groove 110 formed in the housing and has inturned free ends 112 which seat behind offset walls 114 on the housing 52 with the clip 108 assembled. The clip 108 is formed preferably from a spring type metal which permits snap fitting with the housing. The residual forces in the clip 108 maintain the clip 108 on the housing 52 so that no additional fasteners are required. The clip has oval slots 116 through which the cable passes. The slots accommodate flexing of the cable to facilitate assembly with the connector/actuator as described below.

The connector/actuator module 44 comprises a U-shaped channel 118, preferably made of metal for guiding vertical translatory movement of a rectangular slide plate 120. The channel 118 has a hole 122 through which a rotary shaft 124, associated with a crank 125, passes. Integral with the shaft is a flat disc 126 carrying an eccentric pin 127. The end of the cable is squared and keyed in a complementary square slot 128 in the shaft 124 so that the pin 127 rotates about the axis of the shaft in response to rotation of the cable 50.

The pin 127 moves in an L-shaped guide slot 130 in the slide plate 120, which has integral guide rails 132. The rails 132 maintain the plate 120 spaced from the web 134 of the channel 118 a distance approximately equal to the thickness of the disc 126 and at the same time reduce friction between the slide plate and channel for smoother operation. The orientation of the slot 130 can be reversed depending upon which side of the cabinet 12 the connector/actuator module is located.

To provide a self-contained connector/actuator module, the legs 136 of the channel 118 are outturned intermediate their length and doubled back against the outturned portion 138 so that the free edge 140 of the legs overlaps and captures the slide plate 120 and in turn the crank 125 in operative association with the channel 118. The outturned portion 136 and overlapping portion 142 doubled thereover have drilled holes 144 to accept fasteners (not shown) for mounting the connector/actuator with the cabinet 12.

To manipulate the locking bars 26, a cylindrical boss 146 is provided on the plate 120. The boss 146 is guided vertically in an oval slot 148 in the channel 118. The boss 146 has a bore 150 for the reception of a pin 152 on the locking bar 26 so that the locking bar follows translatory movement of the plate 120. Obviously, the pin may be mounted to the plate and the bore provided in the locking bar.

The crank 125, which is preferably made from a synthetic resin, is positioned in one of two positions by selectively operating the key 48. In a first, locked position, the pin 127 resides at the end 154 of the horizontal leg 156 so that the plate 120 is thrown vertically upward, thereby aligning the lugs 28 at the blocking surface 36 so that drawer removal is prohibited. Simultaneously the boss 146 seats against the upper edge 158 of the slot 148. Vertical shifting of the slide bar is prohibited by the engagement of the pin 127 in the leg 156.

Rotation of the crank 125 oppositely to the direction described in the previous paragraph locates the pin 127 at the juncture of the vertical leg 160 and horizontal leg 156. In the latter position reciprocative movement of the slide plate 120 is permitted as effected by the drawers 14,214 acting upon the lugs 28 on the locking bar 26, 226 upon passage over the ramp plates 24, 224 from either direction. The drawers in the latter position are unlocked so as to be freely withdrawn.

It should be understood that the ramp plates 24 could be omitted and all drawers opened at the same time. In this event the slide bar 26 is movable only by the keyed operator. The vertical slot in the slide plate could be omitted, although this would be unnecessary.

To provide a locking feel to the system, a U-shaped hair spring 162 is anchored to the guide channel 118. To anchor the spring 162, the channel is stamped to provide an anchoring bar 164 defining two vertical openings 166. The base 168 of the spring 162 is formed about the bar 164 and extends through the openings 166 so as to be confined against shifting relative to the plate 120. The spring could be assembled alternatively using screws, rivets or the like. Each of the legs of the spring are bent inwardly in the shape of a V with the apex 170 of the V intersecting the oval slot 148. As the boss 146 passes in the slot beyond the apexes, a detent-type action occurs, urging the thrown slide plate 120 to either the locked or unlocked positions. The spring should be rigid enough to overcome gravitational forces on the bar with the bar in a raised position. The spring also alerts the user when the locked or unlocked position is realized.

It can be seen that the system is effectively operable regardless of the configuration of the particular piece of furniture. Adjustment in cable length and selective location of the gear 68 on the cable accommodate assymetrical constructions. Required tolerances are reduced. Simple, press fitting assembly between the cable and crank is facilitated by the squared cable end and mating slot 128.

I claim:

1. For use with an article of furniture having at least one drawer and a reciprocative slide bar selectively movable between a drawer locked position and a drawer unlocked position, an improved locking system comprising:

a flexible cable having opposite ends;

operator means engaging said cable selectively at any one of a plurality of positions intermediate said ends for rotating said cable about the longitudinal axis thereof; and a connector/actuator means operatively associated between one end of the cable and slide bar for converting rotation of the cable about its longitudinal axis into reciprocative movement of the slide bar selectively to the drawer locked and drawer unlocked positions.

2. An improved furniture locking system according to claim 1 wherein said connector/actuator means comprises a crank carrying an eccentric pin, means operatively engaging the crank with the cable for rotation therewith, a slide plate having a slot for receiving the eccentric pin, and means connecting the slide plate with the slide bar, said eccentric pin being guided in the slot as an incident of rotation of the crank to effect translation of the slide plate.

3. An improved furniture locking system according to claim 1 wherein said connector/actuator means comprises a crank carrying an eccentric pin, means operatively engaging the crank with the cable for rotation therewith, a slide plate having a slot for receiving the eccentric pin, and means connecting the slide plate with the slide bar, said eccentric pin being guided in the slot as an incident of rotation of the crank to effect translation of the slide plate, said means connecting the slide plate with the slide bar comprising a pin on the slide bar and a bore on the slide plate for receiving said pin.

4. An improved furniture locking system according to claim 1 wherein said connector/actuator means comprises a crank carrying an eccentric pin, means operatively engaging the crank with the cable for rotation therewith, a slide plate having a slot for receiving the eccentric pin, and means connecting the slide plate with the slide bar, said eccentric pin being guided in the slot as an incident of rotation of the crank to effect translation of the slide plate, said crank comprising a shaft rotatable about a first axis and a disc integral with said shaft extending in a plane perpendicular to said first axis and carrying said eccentric pin.

5. An improved furniture locking system according to claim 1 wherein said connector/actuator means comprises a crank carrying an eccentric pin, means operatively engaging the crank with the cable for rotation therewith, a slide plate having a slot for receiving the eccentric pin, and means connecting the slide plate with the slide bar, said eccentric pin being guided in the slot as an incident of rotation of the crank to effect translation of the slide plate, said means operatively engaging the crank with the cable comprising a slot in the crank, said cable having an end keyed in the crank in said slot.

6. An improved furniture locking system according to claim 1 wherein said connector/actuator means comprises a crank carrying an eccentric pin, means operatively engaging the crank with the cable for rotation therewith, a slide plate having a slot for receiving the eccentric pin, means connecting the slide plate with the slide bar, said eccentric pin being guided in the slot as an incident of rotation of the crank to effect translation of the slide plate, means defining a guide channel for slidingly receiving the slide plate, and means for mounting the guide channel to the furniture article.

7. An improved furniture locking system according to claim 1 wherein said connector/actuator means comprises a crank carrying an eccentric pin, means operatively engaging the crank with the cable for rotation therewith, a slide plate having a slot for receiving the eccentric pin, and means connecting the slide plate with the slide bar, said eccentric pin being guided in the slot as an incident of rotation of the crank to effect translation of the slide plate, said slot in the slide plate comprising a first leg and a second leg transverse to the first leg, said eccentric pin being received in said first leg in said drawer locked position, said eccentric pin being received in said second leg in said drawer unlocked position.

8. For use with an article of furniture having at least one drawer and a reciprocative slide bar selectively movable between a drawer locked position and a drawer unlocked position, an improved locking system comprising:

a flexible cable;

operator means for rotating said cable about the longitudinal axis thereof; and a connector/actuator means operatively associated between the cable and slide bar for converting rotation of the cable about its longitudinal axis into reciprocative movement of the slide bar selectively to the drawer locked and drawer unlocked positions, said connector/actuator means comprising a crank carrying an eccentric pin, means operatively engaging the crank with the cable for rotation therewith, a slide plate having a slot for receiving the eccentric pin, means connecting the slide plate with the slide bar, said eccentric pin being guided in the slot as an incident of rotation of the crank to effect translation of the slide plate, means defining a guide channel for slidingly receiving the slide plate, and means for mounting the guide channel to the furniture article, said guide channel having an oval slot and said slide plate having a cylindrical boss guided within said slot between the drawer locked and drawer unlocked positions.

9. The improved furniture locking system according to claim 8 wherein said slot comprises an L-shaped slot.

10. For use with an article of furniture having at least one drawer and a reciprocative slide bar selectively movable between a drawer locked position and a drawer unlocked position, an improved locking system comprising:

a flexible cable;

operator means for rotating said cable about the longitudinal axis thereof;

a connector/actuator means operatively associated between the cable and slide bar for converting rotation of the cable about its longitudinal axis into reciprocative movement of the slide bar selectively to the drawer locked and drawer unlocked positions, said connector/actuator means comprising a crank carrying an eccentric pin, means operatively engaging the crank with the cable for rotation therewith, a slide plate having a slot for receiving the eccentric pin, means connecting the slide plate with the slide bar, said eccentric pin being guided in the slot as an incident of rotation of the crank to effect translation of the slide plate, means defining a guide channel for slidingly receiving the slide plate, means for mounting the guide channel to the furniture article, said guide channel having an oval slot and said slide plate having a cylindrical boss guided within said oval slot between the drawer locked and drawer unlocked positions; and spring meams secured to said guide channel means and having a portion extending into said oval slot for urging said boss selectively to dispose said slide bar in the drawer locked and drawer unlocked positions.

11. For use with an article of furniture having a support and a plurality of drawers carried by said support, a reciprocative slide bar associated with a first of said drawers selectively movable between a drawer locked position and a drawer unlocked position, and a translatable locking bolt for locking a second of said drawers including a tab extending in a locked position to prevent withdrawal of the second drawer from the support, an improved locking system comprising:

a flexible cable having an end of noncircular cross section;

operator means for effecting rotation of the cable about its longitudinal axis and having a keyed tumbler including a barrel with an eccentric lug rotatable by a key and a toothed rack having a slot for receiving said lug and translatable upon rotation of the barrel, and a gear is adjustably, fixedly secured with said cable in meshed relationship with the toothed rack for causing rotation of the cable as an incident of rotation of the barrel;

connector/actuator means longitudinally removably connecting said cable end to said slide bar for converting rotation of the cable into reciprocative movement of the slide bar; and means operatively connecting the cable and locking bolt for translation of the locking bolt as an incident of rotation of said cable about its longitudinal axis, rotation of the cable by the operator in a first direction simultaneously disposing the slide bar in a drawer locked position and translating the bolt to a locked position preventing withdrawal of the second drawer.

12. An improved furniture locking system according to claim 11 wherein said operator includes a housing having a cutout guiding sliding movement of the rack, and means are provided fixing the housing to the support.

13. An improved furniture locking system according to claim 11 wherein said operator includes a housing having a cutout guiding sliding movement of the rack, and means are provided fixing the housing to the support, said bolt being U-shaped and surrounding the rack.

14. For use with an article of furniture having a support and a plurality of drawers carried by said support, a reciprocative slide bar associated with a first of said drawers selectively movable between a drawer locked position and a drawer unlocked position, and a translatable locking bolt for locking a second of said drawers including a tab extending in a locked position to prevent withdrawal of the second drawer from the support, an improved locking system comprising:

a flexible cable having an end of noncircular cross section;

operator means for effecting rotation of the cable about its longitudinal axis;

connector/actuator means longitudinally removably connecting said cable end to said slide bar for converting rotation of the cable into reciprocative movement of the slide bar; and means operatively connecting the cable and locking bolt for translation of the locking bolt as an incident of rotation of said cable about its longitudinal axis, rotation of the cable by the operator in a first direction simultaneously disposing the slide bar in a drawer locked position and translating the bolt to a locked position preventing withdrawal of the second drawer, said cable having a substantially uniform cross-section configuration and the means operably connecting the cable and locking bolt are keyed to the cable and slidable along its length to accommodate different support configurations.

15. An improved furniture locking system according to claim 14 wherein said cable has a first end and the means operably connecting the cable and locking bolt are crimped to the cable, said connector/actuator having a rotatable crank including a shaft with a square slot, said cable first end mating said shaft closely with the slot.

16. An improved furniture locking system according to claim 14 wherein said cable has a first end, said connector/actuator having a rotatable crank including a shaft with a square slot, and said cable first end mating said shaft closely within the slot, said shaft having an integral disc carrying an eccentric pin, said connector/actuator including a translatable slide plate having a slot for receiving said eccentric pin for causing said slide plate to translate as an incident of rotation of the cable.

17. An improved furniture locking system according to claim 14 wherein said cable has a first end, said connector/actuator having a rotatable crank including a shaft with a square slot, and said cable first end mating said shaft closely within the slot, and means defining a U-shaped guide channel for guiding movement of the slide plate, said guide channel having integral outturned flanges for use in assembling the guide channel means to the support.

18. An improved furniture locking system according to claim 14 wherein said cable has a first end, said connector/actuator having a rotatable crank including a shaft with a square slot, and said cable first end mating said shaft closely within the slot, said shaft having an integral disc carrying an eccentric pin, said connector/actuator including a translatable slide plate having a slot for receiving said eccentric pin for causing said slide plate to translate as an incident of rotation of the cable, and means defining a U-shaped guide channel, said slide plate having a plurality of spaced rails engaging the guide channel means for guiding movement of the slide plate along the guide channel.

19. An improved furniture locking system according to claim 14 wherein said cable has a first end, said connector/actuator having a rotatable crank including a shaft with a square slot, and said cable first end mating said shaft closely within the slot, and means defining a U-shaped guide channel for guiding movement of the slide plate, said guide channel means having integral outturned flanges for use in assembling the guide channel means to the support, said guide channel formed of metal and said crank being formed of synthetic resin.

20. For use with an article of furniture having a support and at least one drawer carried by said support and a reciprocative slide bar associated with the one drawer and selectively movable between a drawer locked and a drawer unlocked position, an improved locking system comprising:

a connector/actuator module mounted on the support and in operative association with the slide bar;

an operator module mounted on the support and spaced from the connector/actuator; and a flexible cable operatively connected between the operator module and connector/actuator module and rotatable about its longitudinal axis in response to actuation of said operator to effect selective reciprocative movement of the slide bar to the driver locked and drawer unlocked positions, wherein said operator module has a housing and a translatable toothed rack and a gear is adjustably, fixedly attached to the cable so that translation of the rack effects rotation of the cable about its longitudinal axis.

21. An improved furniture locking system according to claim 20 wherein the gear engages the toothed rack so that translation of the rack effects rotation of the cable about its longitudinal axis, and means are provided for translating the toothed rack, said gear having an integral sleeve which is slidable along at least a portion of the length of the flexible cable, and means are provided fixing the sleeve to the cable at a selected position.

22. An improved furniture locking system according to claim 20 wherein said housing has a cavity, the gear extends into the cavity and meshes with the toothed rack and clip means engage the housing and maintain the gear operatively engaged with the toothed rack.

23. For use with an article of furniture having a support and at least one drawer carried by said support and a reciprocative slide bar associated with the one drawer and selectively movable between a drawer locked and a drawer unlocked position, an improved locking system comprising:

a connector/actuator module mounted on the support and in operative association with the slide bar;

an operator module mounted on the support and spaced from the connector/actuator; and a flexible cable operatively connected between the operator module and connector/actuator module and rotatable about its longitudinal axis in response to actuation of said operator to effect selective reciprocative movement of the slide bar to the drawer locked and drawer unlocked positions, said connector/actuator having a U-shaped channel, a crank including an integral rotary shaft extending through a hole in the channel and an eccentric pin, and a slide plate including a slot engaging said eccentric pin and translatable within the guide channel upon rotation of the rotary shaft, said guide channel having integral bent legs which overlap the plane of the plate and maintain the slide plate against the guide channel and in turn the rotary shaft within the hole in the channel.

24. For use with an article of furniture having a support and at least one drawer carried by said support and a reciprocative slide bar associated with the one drawer and selectively movable between a drawer locked and a drawer unlocked position, an improved locking system comprising:

a connector/actuator module mounted on the support and in operative association with the slide bar;

an operator module mounted on the support and spaced from the connector/actuator; and a flexible cable operatively connecting between the operator module and connector/actuator module and rotatable about its longitudinal axis in response to actuation of said operator to effect selective reciprocative movement of the slide bar to the drawer locked and drawer unlocked positions, said connector/actuator module having a U-shaped guide channel, a crank including an integral rotary shaft extending through a hole in the channel and an eccentric pin, a slide plate including a boss movable in an oval slot in the guide channel between the drawer locked and drawer unlocked positions and a slot in the slide plate engaging the eccentric pin and guiding reciprocative movement of the slide plate in the guide channel as an incident of rotation of the crank and spring means extend into the oval slot to bias the boss on the slide plate to each of the drawer locked and drawer unlocked position.

25. An improved furniture locking system according to claim 24 wherein an anchoring bar is struck from the channel and defines an opening and said spring means extend through said opening and engage about the anchoring bar so as to be held fixedly relative to the channel.

26. For use with an article of furniture having a support and at least one drawer carried by the support and a reciprocative slide bar selectively movable between a drawer locked and a drawer unlocked position, an improved locking system comprising:

a connector/actuator module including a rotary crank operatively connected with the slide bar and as an incident of rotation thereof effecting reciprocative movement of the slide bar between the drawer locked and drawer unlocked positions;

an operator module including a housing, a toothed rack translatable relative to the housing and means to translate the rack;

a flexible cable rotatable about its longitudinal axis;

means connecting the cable with the toothed rack to effect rotation of the cable upon translation of the rack; and means for press fitting the end of the cable with the crank.

27. The improved furniture locking system according to claim 26 wherein the means connecting the cable with the toothed rack comprises a gear fixed to the cable and clip means snap fit to the housing and maintain the gear in engagement with the toothed rack, whereby said operator module and connector/actuator module can be fixed with the support and thereafter the cable separately snap fit to each of the connector/actuator module and operator module.

* * * * *